US008661996B2

(12) United States Patent
Inoue

(10) Patent No.: US 8,661,996 B2
(45) Date of Patent: Mar. 4, 2014

(54) SEWING MACHINE AUXILIARY STORAGE COMPARTMENT

(75) Inventor: Takashi Inoue, Osaka (JP)

(73) Assignee: Jaguar International Corporation, Osaka (JP)

( * ) Notice: Subject to any disclaimer, the term of this patent is extended or adjusted under 35 U.S.C. 154(b) by 0 days.

(21) Appl. No.: 13/584,399

(22) Filed: Aug. 13, 2012

(65) Prior Publication Data

US 2013/0098280 A1 Apr. 25, 2013

(30) Foreign Application Priority Data

Oct. 20, 2011 (JP) ..... 2011-230789
Jun. 20, 2012 (JP) ..... 2012-138286

(51) Int. Cl.
*D05B 73/06* (2006.01)
*D05B 75/00* (2006.01)

(52) U.S. Cl.
USPC ..... 112/260

(58) Field of Classification Search
USPC ..... 112/258, 260, 217.1–217.4; 108/143; D15/66–76
See application file for complete search history.

(56) References Cited

U.S. PATENT DOCUMENTS

| | | | | | |
|---|---|---|---|---|---|
| 3,013,514 | A * | 12/1961 | Stanton | 112/260 |
| 4,089,573 | A * | 5/1978 | Aeschliman | 312/27 |
| D255,360 | S * | 6/1980 | Sibuya et al. | D15/68 |
| 4,220,103 | A * | 9/1980 | Kasahara et al. | 112/260 |
| 4,224,887 | A * | 9/1980 | Meier | 112/260 |
| 5,343,821 | A * | 9/1994 | Tseng | 112/258 |
| 6,874,430 | B1 * | 4/2005 | McCandless | 108/90 |
| 7,293,514 | B2 | 11/2007 | Fukao | |
| 2006/0191447 | A1 * | 8/2006 | Ashby et al. | 108/119 |

* cited by examiner

*Primary Examiner* — Ismael Izaguirre
(74) *Attorney, Agent, or Firm* — Husch Blackwell LLP

(57) ABSTRACT

A sewing machine auxiliary storage compartment is provided that can be attached to or detached from a sewing machine body part and that allows small articles such as accessories to be taken out therefrom or put thereinto even during sewing. Upper and lower parts are attached slidably with respect to each other. The upper part 11 is provided with an attachment part 116 that can be attached to the sewing machine body part by its one end. The lower part 12 is attached to the upper part 11 slidably in a direction crossing a workpiece feeding direction when the upper part 11 and the sewing machine body part are attached together. A storage part 122 for storing accessories is provided in the lower part 12, which is located on the opposite side to the one end.

11 Claims, 8 Drawing Sheets

SEWING MACHINE AUXILIARY STORAGE COMPARTMENT

BACKGROUND OF THE INVENTION

1. Field of the Invention

The present invention relates to a sewing machine auxiliary storage compartment that can be attached to or detached from a sewing machine body part and can store small articles such as accessories (for example, a presser foot) for the sewing machine.

2. Description of the Related Art

A compact sewing machine often doesn't provide sufficient space where a workpiece to be fed is spread out during sewing. In many cases, therefore, it is devised that for example, a detachable auxiliary table is attached to secure a space where a workpiece can be spread out and thereby to enable steady cloth feeding.

On the other hand, in order to prevent, for example, accessories for a sewing machine from being lost, the auxiliary table or the like often is provided with a storage part, for example, for accessories. For instance, JP 2006-271827A discloses an auxiliary cover that can be attached to a sewing machine bed. Inside the auxiliary cover disclosed in JP 2006-271827A, a storage part covered from above with lid member is formed so as to be openable and closable. When the lid member is detached upwards, small articles such as accessories stored in the storage part can be taken out.

However, the auxiliary cover disclosed in JP 2006-271827A has a problem in that since the lid member of the storage part is located under a workpiece when it is sewn with the auxiliary cover being attached to the sewing machine bed, small articles such as accessories cannot be taken out therefrom or put thereinto during sewing. For example, when the accessories stored in the storage part are needed, the workpiece which is being sewn is removed once and then the accessories are taken out, which is followed by spreading the workpiece over the auxiliary cover again to sew it. Thus the operation would be cumbersome.

SUMMARY OF THE INVENTION

The present invention was made with such situations in mind and is intended to provide a sewing machine auxiliary storage compartment that can be attached to or detached from a sewing machine body part and allows small articles such as accessories to be taken out therefrom or put thereinto even during sewing.

In order to solve the above mentioned problem, a first aspect of a sewing machine auxiliary storage compartment is characterized in that upper and lower parts that are attached slidably with respect to each other, the upper part is provided with an attachment part that can be attached to a sewing machine body part by its one end, the lower part is attached to the upper part slidably in a direction crossing a workpiece feeding direction when the upper part and the sewing machine body part are attached together, and a storage part for storing accessories is provided in the lower part, which is located on the opposite side to the one end.

In the first invention, the upper and lower parts are attached slidably with respect to each other. The upper part is provided with the attachment part that can be attached to the sewing machine body part by its one end. The lower part is attached to the upper part slidably in the direction crossing the workpiece feeding direction when the upper part and the sewing machine body part are attached together. The storage part for storing accessories is provided in the lower part, which is located on the opposite side to the one end. Thus, even when a workpiece is being sewn, with the auxiliary storage compartment being attached to the sewing machine body part, the lower part does not slide in the workpiece feeding direction to allow the storage part to be drawn out. Accordingly, the operations of opening and closing the storage part are not obstructed by the workpiece that is being sewn and the small articles such as accessories, which are stored in the storage part, can be taken out therefrom or put thereinto.

A second aspect of the sewing machine auxiliary storage compartment, according to the first invention, is characterized in that, the upper part is provided with a cut part that has a substantial U-shape in plan view, and is formed so that the sewing machine body part fits into the cut part.

In the second invention, the upper part is provided with the cut part that has a substantial U-shape in plan view, and is formed so that the sewing machine body part fits into the cut part. Therefore, the lower part can be slid in the direction crossing the workpiece feeding direction and away from the sewing machine body part side. Thus, even when a workpiece is being sewn, with the auxiliary storage compartment being attached to the sewing machine body part, the lower part does not slide in the workpiece feeding direction to allow the storage part to be drawn out. Accordingly, the operations of opening and closing the storage part are not obstructed by the workpiece that is being sewn and the small articles such as accessories, which are stored in the storage part, can be taken out therefrom or put thereinto.

A third aspect of the sewing machine auxiliary storage compartment, according to the first or second invention, is characterized in that either the upper part or the lower part is provided with a guide rail that allows the upper and lower parts to slide with respect to each other, either the upper part or the lower part, which is not provided with the guide rail, is provided with a plurality of rollers whose size allows them to move along the guide rail, and the guide rail is provided with a plurality of projections disposed at predetermined positions, over which the rollers can move.

In the third invention, either the upper part or the lower part is provided with the guide rail that allows the upper and lower parts to slide with respect to each other and either the upper part or the lower part, which is not provided with the guide rail, is provided with the plurality of rollers whose size allows them to move along the guide rail. Since the guide rail is provided with the plurality of projections disposed at predetermined positions, over which the rollers can move, the rollers are caught by the projections. This prevents the lower part from sliding out all at once. This makes it possible to avoid small articles such as accessories stored in the storage part from jumping out or being damaged by the shock from sliding.

Furthermore, a fourth aspect of the sewing machine auxiliary storage compartment, according to any one of the first to third invention, is characterized in that the lower part is provided with a locking member that locks a slide of the lower part while being accommodated in the upper part.

In the fourth invention, the lower part is provided with the locking member that locks the slide of the lower part while being accommodated in the upper part. Therefore, for example, when the sewing machine is moved, with the auxiliary storage compartment being attached thereto, the lower part does not slide to allow the storage part to be drawn out. This makes it possible to avoid small articles such as accessories stored in the storage part from jumping out to be lost or damaged, for example.

A fifth aspect of the sewing machine auxiliary storage compartment, according to the fourth invention, comprising a biasing member that imparts a biasing force for allowing the lower part to slide in the direction crossing the workpiece feeding direction is characterized in that the biasing force of the biasing member allows the lower part to slide, when the slide of the lower part is unlocked.

In the fifth invention, the biasing member that imparts a biasing force for allowing the lower part to slide in the direction crossing the workpiece feeding direction is provided, and when the slide of the lower part is unlocked by the locking member, the biasing force of the biasing member allows the lower part to slide. Accordingly, when the slide of the lower part is unlocked by the locking member, the storage part can be drawn out easily without any operations of, for example, manually sliding the lower part.

According to the present invention, the lower part is attached to the upper part slidably in the direction crossing the workpiece feeding direction when the upper part and the sewing machine body part are attached together, and the storage part for storing accessories is provided in the lower part, which is located on the opposite side to the one end. Thus, even when a workpiece is being sewn, with the auxiliary storage compartment being attached to the sewing machine body part, the lower part does not slide in the workpiece feeding direction to allow the storage part to be drawn out. Accordingly, the operations of opening and closing the storage part are not obstructed by the workpiece that is being sewn and the small articles such as accessories, which are stored in the storage part, can be taken out therefrom or put thereinto.

BEST MODE FOR CARRYING OUT THE INVENTION

Figure 1:
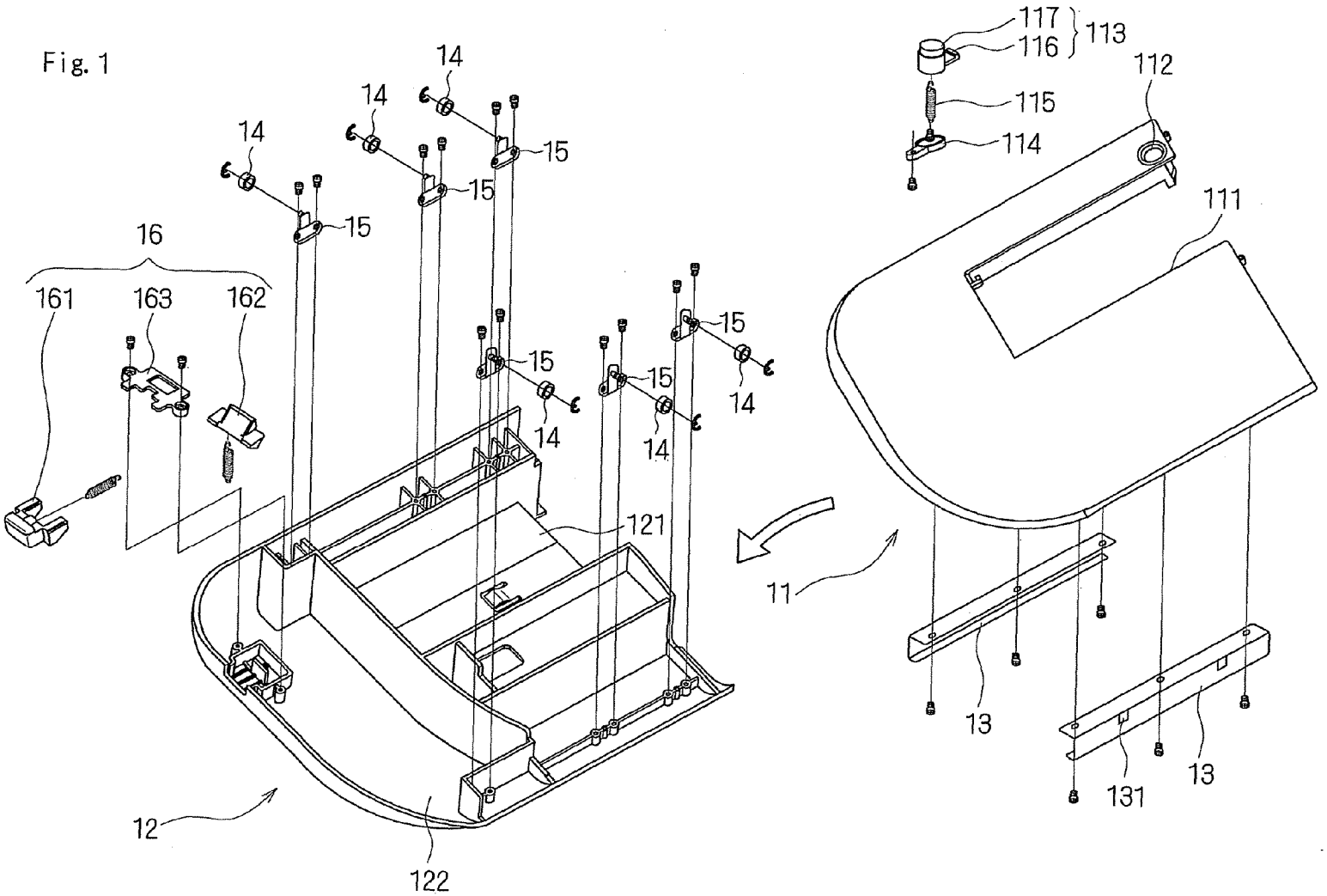
FIG. 1 is a perspective view showing the part structure of a sewing machine auxiliary storage compartment according to an embodiment of the present invention.

Hereinafter, the sewing machine auxiliary storage compartment according to the embodiment of the present invention is described in detail with reference to the drawings. FIG. 1 is a perspective view showing the part structure of the sewing machine auxiliary storage compartment according to the embodiment of the present invention.

As shown in FIG. 1, the sewing machine auxiliary storage compartment according to the embodiment is composed of an upper part 11 and a lower part 12. The upper part 11 is provided, on the lower part 12 side, with a guide rail 13 that allows the lower part 12 to slide.

Figure 2:
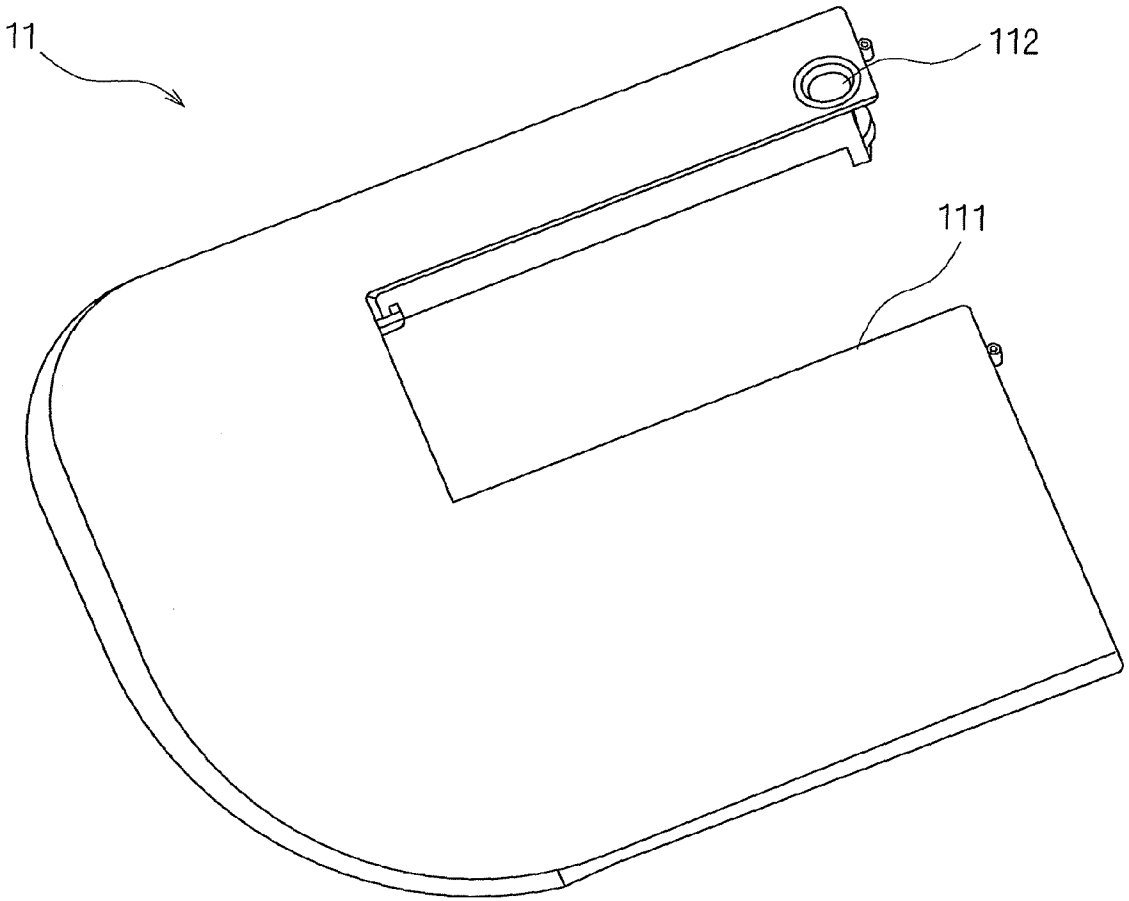
FIG. 2 is a perspective view showing the structure of an upper part of the sewing machine auxiliary storage compartment according to the embodiment of the present invention.

FIG. 2 is a perspective view showing the structure of the upper part 11 of the sewing machine auxiliary storage compartment according to the embodiment of the present invention. As shown in FIG. 2, the upper part 11 is provided with a cut part 111 to have a substantial U-shape in plan view and is formed so that the sewing machine body part (the sewing machine bed) with, for example, a needle plate disposed therein fits into the cut part 111. A smooth slope is formed on the upper face of the upper part 11 so as to extend from the sewing machine body part, which allows a workpiece to be fed smoothly during sewing.

Furthermore, the upper part 11 is provided with an opening part 112, into which a button part 113 is inserted. The button part 113 has a hook part (attachment part) 116 that is attached to or detached from the sewing machine body part. The button part 113 is biased upwards by being attached through a supporting member 114 and a biasing member 115 such as a compression spring, with the biasing member 115 being compressed. Pushing down the button part 113 against the biasing force allows the hook part 116 to be detached from the sewing machine body part, and thereby the sewing machine body part and the auxiliary storage compartment can be separated from each other.

Figure 3:
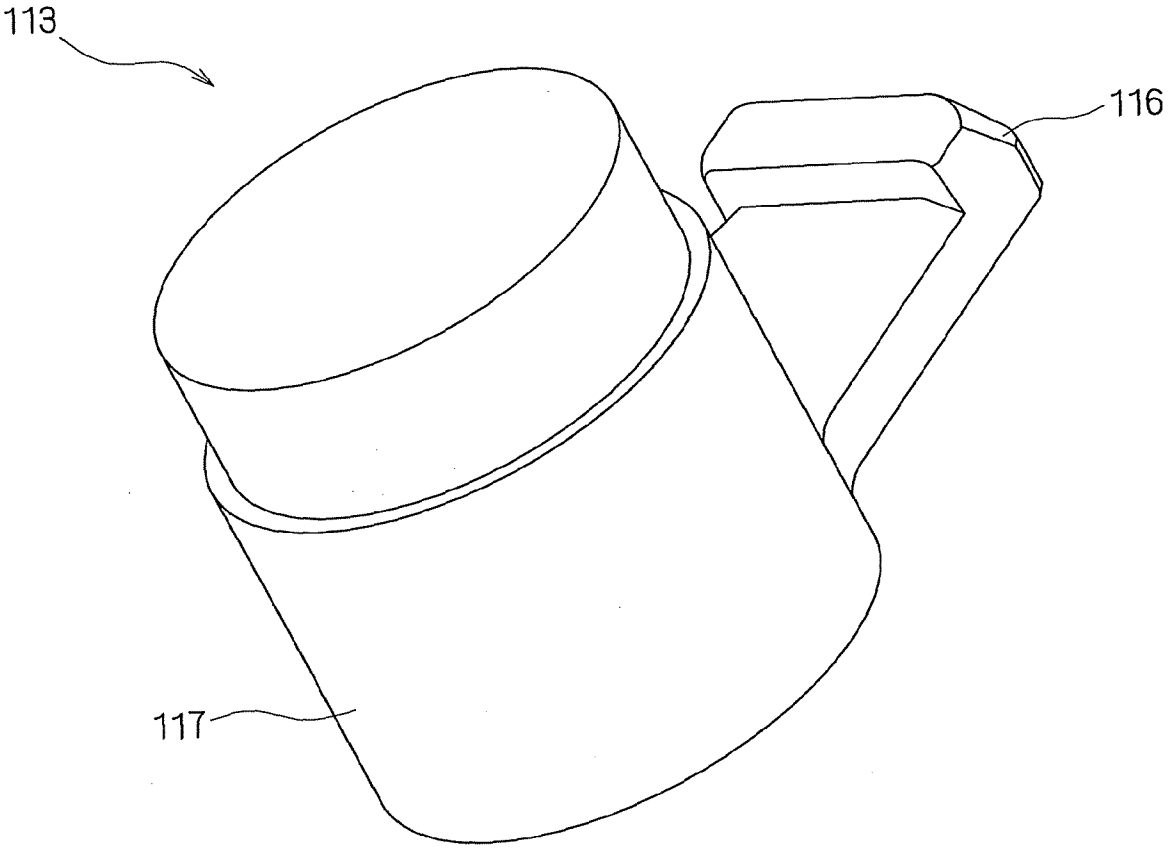
FIG. 3 is a perspective view showing the structure of a button part of the sewing machine auxiliary storage compartment according to the embodiment of the present invention.

FIG. 3 is a perspective view showing the structure of the button part 113 of the sewing machine auxiliary storage compartment according to the embodiment of the present invention. As shown in FIG. 3, the button part 113 is composed of a cylindrical part 117 that a user can push down and the hook part 116 to be engaged with the sewing machine body part. Pushing down the cylindrical part 117 against the biasing force allows the hook part 116 to move downward to be disengaged from the sewing machine body part.

Furthermore, the hook part 116 is tapered from the tip toward the cylindrical part 117 side. Therefore, when being engaged with the sewing machine body part, the hook part 116 is pushed down at the time when the sewing machine body part comes into contact with the tapered part of the hook part 116 as the auxiliary storage compartment is moved toward the sewing machine body part. At the time when the hook part 116 has approached the portion where the sewing machine body part and the hook part 116 are engaged with each other, the biasing force of the biasing member 115 (see FIG. 1) moves the hook part 116 upwards. Thus, the hook part 116 and the sewing machine body part are engaged with each other.

Again with respect to FIG. 1, the lower part 12 is provided with a supporting part 121 that supports the sewing machine body part and a storage part 122 for storing small articles such as accessories. The supporting part 121 is formed to have the same shape in plan view as that of the cut part 111 of the upper part 11.

Figure 4:
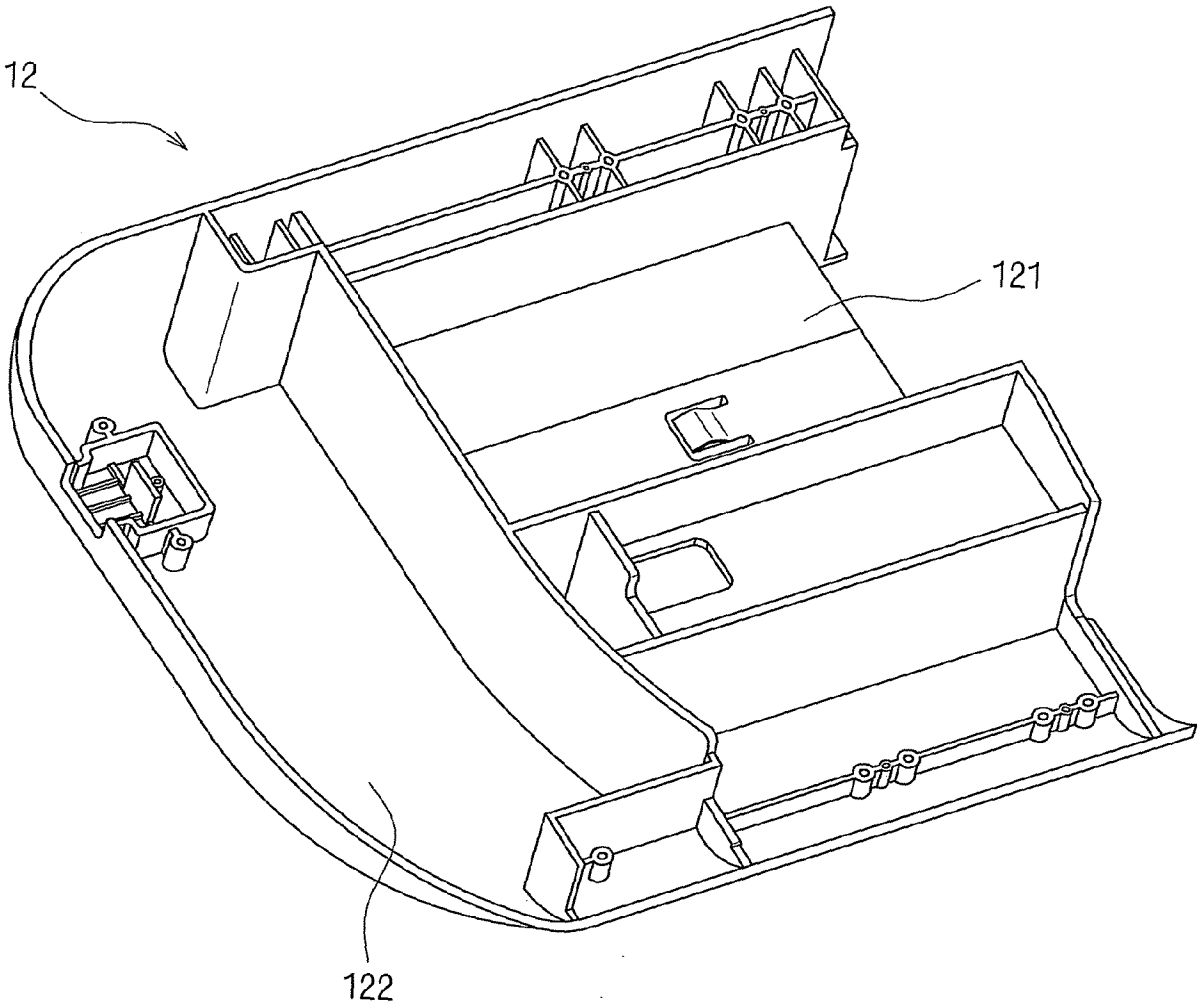
FIG. 4 is a perspective view showing the structure of a lower part of the sewing machine auxiliary storage compartment according to the embodiment of the present invention.

Furthermore, the lower part 12 is attached to the upper part 11 slidably in the direction crossing the workpiece feeding direction when the upper part 11 and the sewing machine body part are attached together. FIG. 4 is a perspective view showing the structure of the lower part 12 of the sewing machine auxiliary storage compartment according to the embodiment of the present invention. As shown in FIG. 4, the storage part 122 for storing accessories is provided in the lower part 12, which is located on the opposite side to the side where the upper part 11 and the sewing machine body part are attached together (one end of the upper part 11). Since the storage part 122 is provided in the lower part 12, which is located on the opposite side to the side where the upper part 11 and the sewing machine body part are attached together, the lower part 12 does not slide in the workpiece feeding direction to allow the storage part 122 to be drawn out even when a workpiece is being sewn, with the upper part 11 and the sewing machine body part being attached together. Accordingly, the operations of opening and closing the storage part 122 are not obstructed by the workpiece that is being sewn and the small articles such as accessories, which are stored in the storage part 122, can be taken out therefrom or put thereinto.

Again with respect to FIG. 1, in the present embodiment, the upper part 11 is provided with the guide rail 13 and the lower part 12 that is not provided with the guide rail 13 is provided with a plurality of rollers 14 that can move along the guide rail 13. The rollers 14 are provided for the roller support mountings 15 and the roller support mountings 15 are disposed linearly along the guide rail 13 of the upper part 11.

Figure 5B:
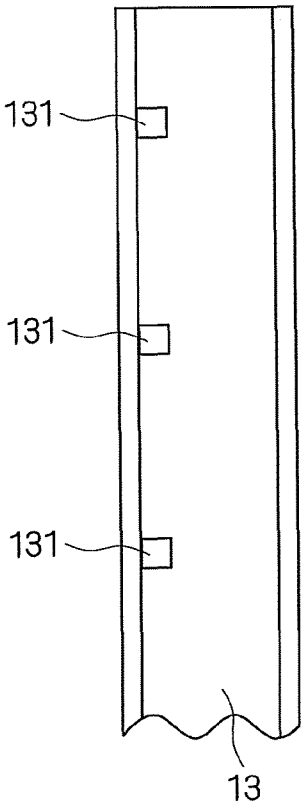
FIGS. 5A and 5B are schematic views showing the structure of a guide rail of the sewing machine auxiliary storage compartment according to the embodiment of the present invention.
Figure 5A:
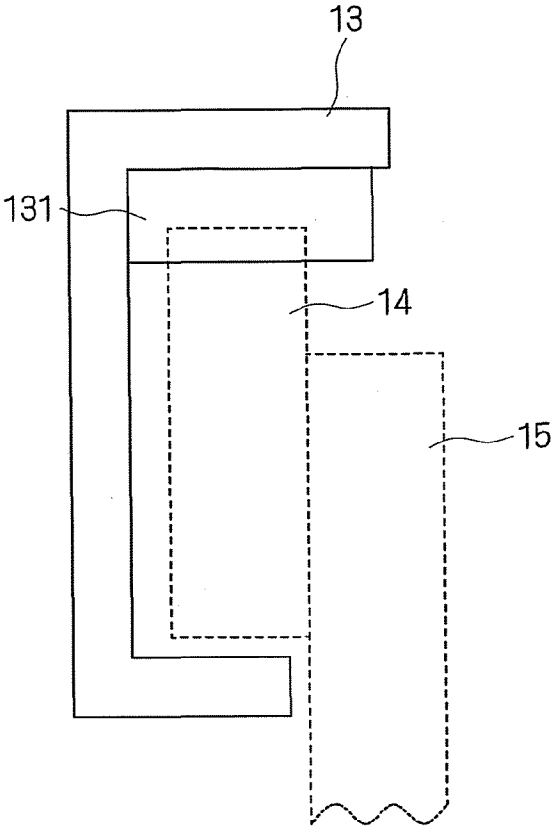

In the guide rail 13, a plurality of projections 131 over which the rollers 14 can move are disposed at predetermined positions. FIGS. 5A and 5B are schematic views showing the structure of the guide rail 13 of the sewing machine auxiliary storage compartment according to the embodiment of the present invention. FIG. 5A is a partial enlarged view that schematically shows the cross-section of the guide rail 13 of the sewing machine auxiliary storage compartment according to the embodiment of the present invention. FIG. 5B is a partial front view of the guide rail 13 of the sewing machine auxiliary storage compartment according to the embodiment of the present invention.

As shown in FIG. 5A, when moving along the guide rail 13, the rollers 14 come into contact with the projections 131. The projections 131 are formed to have a size that allows the rollers 14 to move over them. Thus, application of a little stronger force allows the lower part 12 to slide in the direction crossing the workpiece feeding direction, and thereby the storage part 122 can be drawn out or pushed in.

When such projections 131 are disposed in predetermined scattered positions on the guide rail 13 as shown in FIG. 5B, the lower part 12 can be prevented from sliding out all at once. This makes it possible to avoid small articles such as accessories stored in the storage part 122 from jumping out or being damaged by the shock from sliding.

Again with respect to FIG. 1, the lower part 12 is provided with a locking member 16 that locks the slide of the lower part 12 while being accommodated in the upper part 11. The locking member 16 is composed of an open/close button 161, a stopper 162 and a cover 163.

The stopper 162 protrudes upwards through an opening part of the cover 163 and is biased to the upper side of the cover 163, with a biasing member such as a compression spring being compressed to be attached. The tip of the stopper 162 that protrudes upwards can be engaged with a projection (not shown) provided on the underside of the upper part 11.

Figure 6:
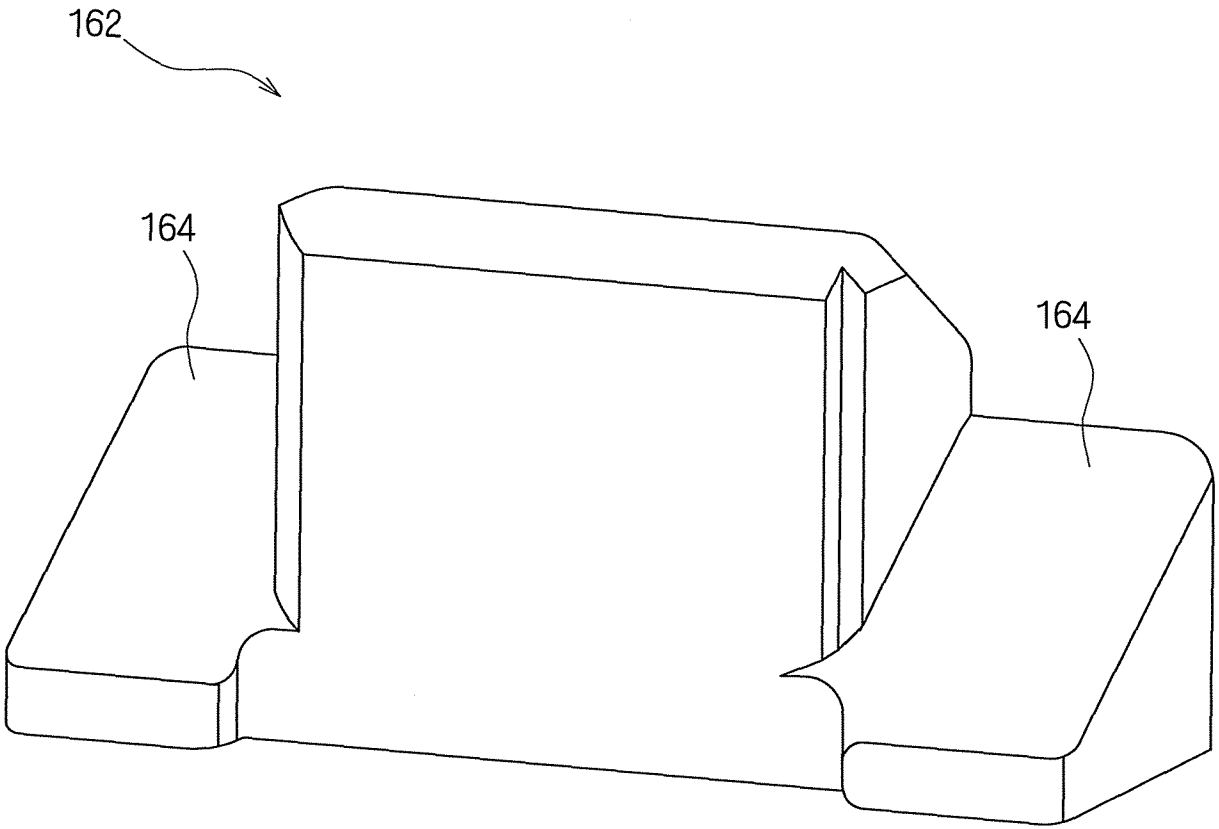
FIG. 6 is a perspective view showing the structure of a stopper of the sewing machine auxiliary storage compartment according to the embodiment of the present invention.
Figure 7:
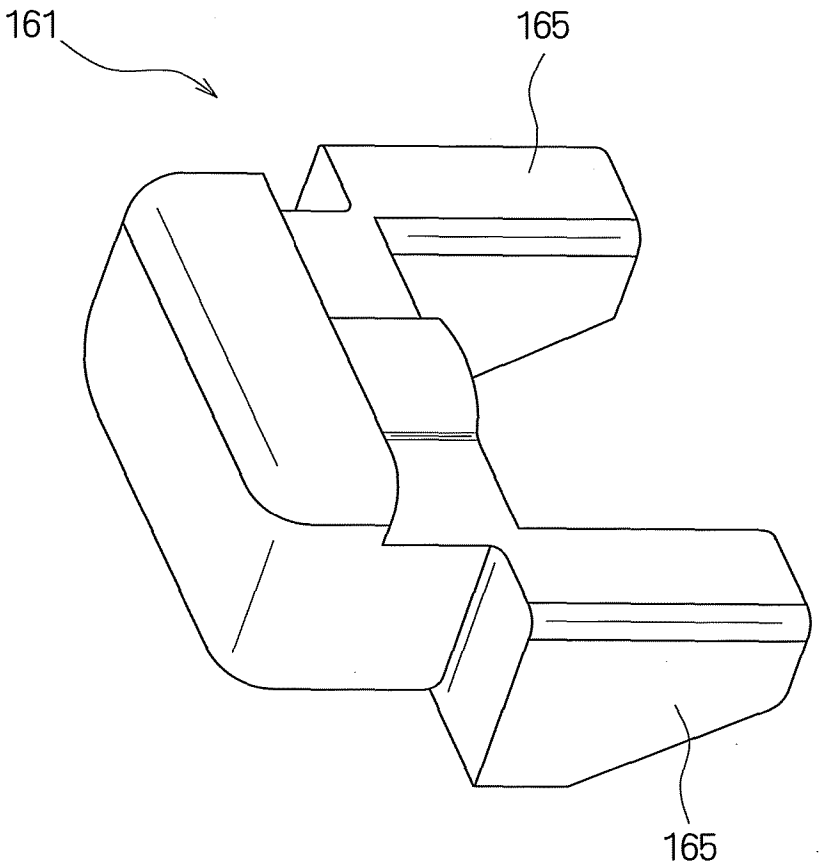
FIG. 7 is a perspective view showing the structure of an open/close button of the sewing machine auxiliary storage compartment according to the embodiment of the present invention.

FIG. 6 is a perspective view showing the structure of the stopper 162 of the sewing machine auxiliary storage compartment according to the embodiment of the present invention. FIG. 7 is a perspective view showing the structure of the open/close button 161 of the sewing machine auxiliary storage compartment according to the embodiment of the present invention. The open/close button 161 is attached to the lower part 12, with the biasing member such as a compression spring being compressed, and thereby is biased to the outer periphery side of the lower part 12. Similarly, the stopper 162 is attached to the cover 163, with the biasing member such as a compression spring being compressed, and thereby is biased upwards. When the open/close button 161 is pushed towards the lower part 12 side against the biasing force, sloped parts 165 of the open/close button 161 shown in FIG. 7 come into contact with sloped parts 164 of the stopper 162 shown in FIG. 6. The sloped parts 165 of the open/close button 161 then slide along the sloped parts 164 of the stopper 162. Thus the stopper 162 moves down against the biasing force. This allows the tip of the stopper 162 to be disengaged from the projection (not shown) provided on the underside of the upper part 11 to unlock the slide of the lower part 12. Then the biasing force of the biasing member allows the lower part 12 to slide, and thereby the storage part 122 can be drawn out.

Since the locking member 16 is provided, the slide of the lower part 12 can be locked, with the lower part 12 being accommodated in the upper part 11. When, for example, the sewing machine is moved, with the auxiliary storage compartment being attached thereto, the lower part 12 does not slide to allow the storage part 122 to be drawn out. This makes it possible to avoid small articles such as accessories stored in the storage part 122 from jumping out to be lost or damaged, for example.

Preferably, an opening and closing mechanism is provided, in which when the locking member 16 unlocks the slide of the lower part 12 with the open/close button 161 thereof, the biasing force of the biasing member allows the lower part 12 to slide, and thereby the storage part 122 can be automatically drawn out. FIGS. 8A to 8D are perspective views showing the structure of the opening and closing mechanism of the sewing machine auxiliary storage compartment according to the embodiment of the present invention.

Figure 8A:
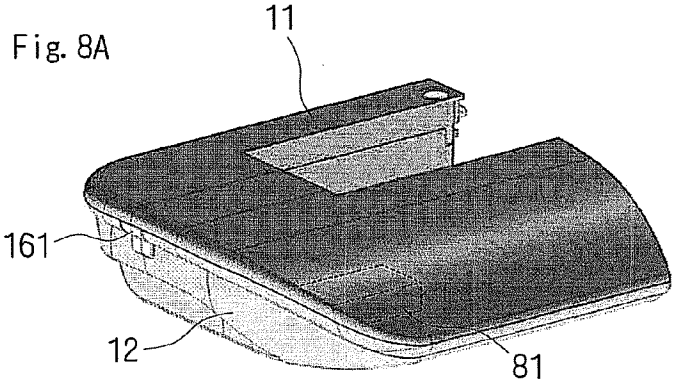
FIGS. 8A to 8D are perspective views showing the structure of an opening and closing mechanism of the sewing machine auxiliary storage compartment according to the embodiment of the present invention.
Figure 8B:
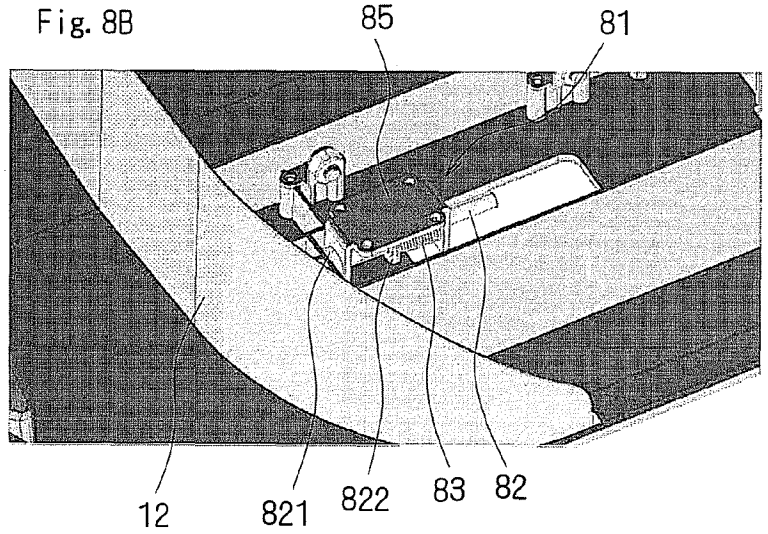

FIG. 8A is a perspective view showing the state of the sewing machine auxiliary storage compartment according to the embodiment of the present invention, with the slide of the lower part 12 accommodated in the upper part 11 being locked. FIG. 8B is a perspective view showing the structure of the opening and closing mechanism of the sewing machine auxiliary storage compartment according to the embodiment of the present invention, with the slide of the lower part 12 accommodated in the upper part 11 being locked. The opening and closing mechanism 81 is composed of a pin 82 that can slide in the direction crossing the workpiece feeding direction, a spring (biasing member) 83 that biases the pin 82 towards the outer periphery side (leftwards in FIG. 8) of the lower part 12, and a fixed member 85 that moves together with the spring 83.

The fixed member 85 is screwed to be fixed to the upper part 11. In the state where the slide of the lower part 12 is locked, i.e. before the open/close button 161 is pushed into the lower part 12 side, the fixed member 85 is in contact with the inner wall of the lower part 12 through one end 821 of the pin 82. Therefore, an intermediate washer 822 of the pin 82 compresses the spring 83 and thereby the pin 82 is biased towards the outer periphery side of the lower part 12.

Figure 8C:
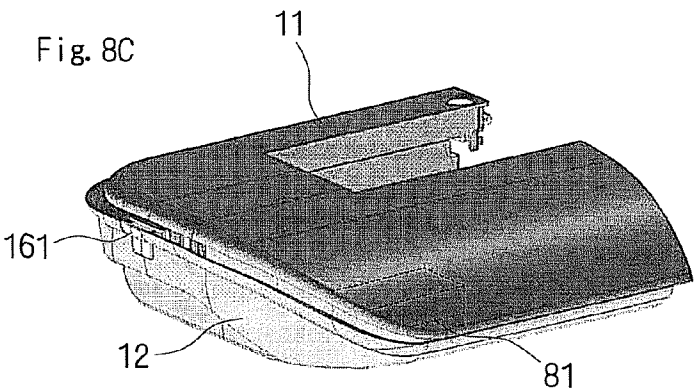
Figure 8D:
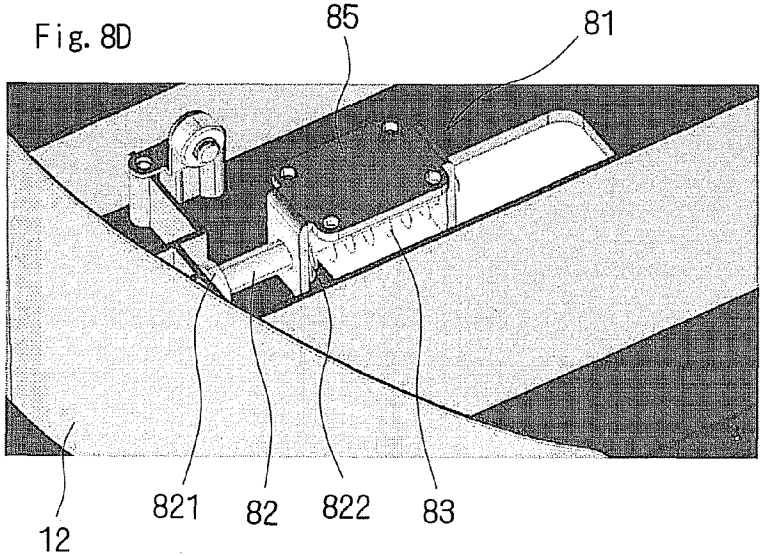

FIG. 8C is a perspective view showing the state of the sewing machine auxiliary storage compartment according to the embodiment of the present invention, with the slide of the lower part 12 being unlocked. FIG. 8D is a perspective view showing the structure of the opening and closing mechanism 81 of the sewing machine auxiliary storage compartment according to the embodiment of the present invention, with the slide of the lower part 12 being unlocked. When the open/close button 161 is pushed into the lower part 12 side, the slide of the lower part 12 is unlocked and thereby the pin 82 allows the lower part 12 to slide towards the outer periphery side (leftwards in FIG. 8) by the biasing force of the spring 83.

In other words, merely pushing the open/close button 161 into the lower part 12 side allows the pin 82 to slide towards the outer periphery side of the lower part 12 and the slide of the pin 82 allows the lower part 12 to slide. Thus, the storage part 122 can be drawn out automatically without any operations of, for example, allowing the lower part 12 to slide manually.

As described above, according to the present embodiment, the lower part 12 is attached to the upper part 11 slidably in the direction crossing the workpiece feeding direction when the upper part 11 and the sewing machine body part are attached together, and the storage part 122 for storing accessories is provided in the lower part 12, which is located on the opposite side to the end (one end) provided with the attachment part that can be attached to the sewing machine body part of the upper part 11. Thus, even when a workpiece is being sewn, with the auxiliary storage compartment being attached to the sewing machine body part, the lower part 12 does not slide in the workpiece feeding direction to allow the storage part 122 to be drawn out. Accordingly, the operations of opening and closing the storage part 122 are not obstructed by the workpiece that is being sewn and the small articles such as accessories, which are stored in the storage part 122, can be taken out therefrom or put thereinto.

In addition, the present invention can be embodied in other forms obtained by adding various modifications to the above-described embodiment without departing from the spirit thereof. For example, in the above-mentioned embodiment, the guide rail 13 is provided for the upper part 11 and the plurality of rollers 14 that can move along the guide rail 13 are provided for the lower part 12. However, it should be understood that the guide rail 13 may be provided for the lower part 12 and the plurality of rollers 14 that can move along the guide rail 13 may be provided for the upper part 11.

The invention may be embodied in other forms without departing from the spirit or essential characteristics thereof. The embodiment disclosed in this application is to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A sewing machine auxiliary storage compartment, wherein upper and lower parts are attached slidably with respect to each other, the upper part is provided with an attachment part that can be attached to a sewing machine body part by its one end, the lower part is attached to the upper part slidably in a direction crossing a workpiece feeding direction when the upper part and the sewing machine body part are attached together, and a storage part for storing accessories is provided in the lower part, which is located on the opposite side to the one end;

wherein either the upper part or the lower part is provided with a guide rail that allows the upper and lower parts to slide with respect to each other, either the upper part or the lower part, which is not provided with the guide rail, is provided with a plurality of rollers whose size allows them to move along the guide rail, and the guide rail is provided with a plurality of projections disposed at predetermined positions, over which the rollers can move.

2. The sewing machine auxiliary storage compartment according to claim 1, wherein the upper part is provided with a cut part that has a substantial U-shape in plan view, and is formed so that the sewing machine body part fits into the cut part.

3. The sewing machine auxiliary storage compartment according to claim 2, wherein either the upper part or the lower part is provided with a guide rail that allows the upper and lower parts to slide with respect to each other, either the upper part or the lower part, which is not provided with the guide rail, is provided with a plurality of rollers whose size allows them to move along the guide rail, and the guide rail is provided with a plurality of projections disposed at predetermined positions, over which the rollers can move.

4. The sewing machine auxiliary storage compartment according to claim 3, wherein the lower part is provided with a locking member that locks a slide of the lower part while being accommodated in the upper part.

5. The sewing machine auxiliary storage compartment according to claim 4, comprising a biasing member that imparts a biasing force for allowing the lower part to slide in the direction crossing the workpiece feeding direction, wherein when the slide of the lower part is unlocked, the biasing force of the biasing member allows the lower part to slide.

6. The sewing machine auxiliary storage compartment according to claim 2, wherein the lower part is provided with a locking member that locks a slide of the lower part while being accommodated in the upper part.

7. The sewing machine auxiliary storage compartment according to claim 6, comprising a biasing member that imparts a biasing force for allowing the lower part to slide in the direction crossing the workpiece feeding direction, wherein when the slide of the lower part is unlocked, the biasing force of the biasing member allows the lower part to slide.

8. The sewing machine auxiliary storage compartment according to claim 1, wherein the lower part is provided with a locking member that locks a slide of the lower part while being accommodated in the upper part.

9. The sewing machine auxiliary storage compartment according to claim 8, comprising a biasing member that imparts a biasing force for allowing the lower part to slide in the direction crossing the workpiece feeding direction, wherein when the slide of the lower part is unlocked, the biasing force of the biasing member allows the lower part to slide.

10. The sewing machine auxiliary storage compartment according to claim 1, wherein the lower part is provided with a locking member that locks a slide of the lower part while being accommodated in the upper part.

11. The sewing machine auxiliary storage compartment according to claim 10, comprising a biasing member that imparts a biasing force for allowing the lower part to slide in the direction crossing the workpiece feeding direction, wherein when the slide of the lower part is unlocked, the biasing force of the biasing member allows the lower part to slide.

* * * * *